United States Patent [19]

Ingemann, deceased

[11] Patent Number: 4,982,555

[45] Date of Patent: Jan. 8, 1991

[54] METHOD AND APPARATUS FOR THE CLOSING OF A CONTAINER

[75] Inventor: Ole Ingemann, deceased, late of Svendborg, Denmark, by Ingrid Therkelsen, legal representative

[73] Assignee: PLM AB, Djaknegatan, Sweden

[21] Appl. No.: 378,196

[22] PCT Filed: Oct. 14, 1988

[86] PCT No.: PCT/SE88/00538

§ 371 Date: Aug. 7, 1989

§ 102(e) Date: Aug. 7, 1989

[87] PCT Pub. No.: WO89/03344

PCT Pub. Date: Apr. 20, 1989

[30] Foreign Application Priority Data

Oct. 15, 1987 [SE] Sweden ..... 8704048

[51] Int. Cl.[5] ..... B65B 7/28; B65B 31/02; C14B 1/02

[52] U.S. Cl. ..... 53/405; 53/97; 53/101; 53/329; 53/432; 53/478; 53/510; 156/68

[58] Field of Search ..... 53/86, 88, 109, 373, 53/381 A, 432, 478, 485, 486, 510, 329, 89, 97, 101, 405, 408, 403; 156/68

[56] References Cited

U.S. PATENT DOCUMENTS

| | | | |
|---|---|---|---|
| 1,649,141 | 11/1927 | Talansier | 53/101 |
| 2,406,771 | 9/1946 | Hughes | 53/101 |
| 3,492,773 | 2/1970 | Bergstrom | 53/433 |
| 3,659,393 | 5/1972 | Richter | 53/433 |
| 3,660,965 | 5/1972 | Morera | 53/329 |
| 3,992,850 | 11/1976 | Vetter | 53/86 X |
| 4,009,552 | 3/1977 | Schlachter | 53/510 X |
| 4,058,953 | 11/1977 | Sanborn, Jr. et al. | 53/86 X |
| 4,154,044 | 5/1979 | Lang | 53/510 X |
| 4,294,056 | 10/1981 | Paulsen et al. | 53/86 |
| 4,296,588 | 10/1981 | Vetter | 53/510 X |
| 4,549,389 | 10/1985 | Zichy | 53/478 X |
| 4,651,497 | 3/1987 | Grimsley | 53/109 X |

FOREIGN PATENT DOCUMENTS

| | | | |
|---|---|---|---|
| 2404197 | 7/1975 | Fed. Rep. of Germany | 53/373 |
| 387619 | 2/1933 | United Kingdom | 53/405 |

*Primary Examiner*—Robert L. Spruill
*Assistant Examiner*—Beth Bianca
*Attorney, Agent, or Firm*—Ladas & Parry

[57] ABSTRACT

The invention relates to a method and a device for the sealing of a container (10) by means of a wafer (20). The container comprises one or more joining means (14, 16) which are adapted so that by a joint (12), e.g. a welding joint, they are connected in a leakproof manner, to the wafer in an edge zone (21) of the same. The wafer is held against a contact surface (32) of a retaining means so as to be moved by the same until it rests in its edge zone (21) against anyone of the joining means (14, 16). While the contact with the retaining means is maintained, the wafer is connected by a fixing means (50) in its edge zone in a leakproof manner to anyone of the joining means through the fixing means supplying energy to the edge zone so that a joint (12) is formed. The invention makes it possible to fix in a leakproof manner a previously cut wafer to the opening part of a container. The sealing can be done even on containers with hot contents, since in certain embodiments the retaining means is cooled with the help of cooling ducts (33). The retaining means cools the wafer and prevents it from being deformed owing to the rise in temperature which the proximity to hot contents otherwise would bring about.

19 Claims, 3 Drawing Sheets

METHOD AND APPARATUS FOR THE CLOSING OF A CONTAINER

FIELD OF THE INVENTION

The present invention relates to a method and to a device for the sealing of a container.

BACKGROUND

A need frequently arises for the sealing of a container, e.g. a container of plastic material, by a laminate whose shape has been adapted to the shape of the opening, prior to the placing of the laminate on, or into, the opening. It has been known to seal containers with the aid of a foil of multilayer material, where the foil, after the container has been sealed, is trimmed in order to remove the parts of the foil projecting outside the edge of the container opening.

One problem which is encountered on the sealing of containers by means of foils, and especially by means of multilayer foils, is that on heating the foil it tends to become deformed because of curling. Since the foil as a rule is relatively thin, it assumes ambient temperature after a short time or is heated rapidly on being subjected to thermal radiaton. Such an environment exists for the foil when containers are to be sealed which are filled with warm or hot contents, and generally occurs on packaging foodstuffs. In certain applications, and especially when the foil is composed of layers of materials having different coefficients of linear expansion, the problem associated with the deformation of the foil is accentuated. When the foil gets warm it will curl so that if on the foil, e.g., the layer with the greatest coefficient of linear expansion faces the container opening, the circumferential outer edge of the foil will be raised, whereas on opposite placing of the layer the outer edge is displaced downwards.

The aforementioned deformations, as a rule, can be overcome if a foil in the form of a band is stretched over one or more containers and is fixed to the opening part of the respective container, so that the foil during sealing is kept stretched by mechanical means which counteract the tendency of the foil to curl. When the foil has thus been fixed, any projecting parts are cut off the respective container. However, in cases where the foil consisting of several layers is cut into wafers, each of a shape corresponding to the shape of the opening part of the container, prior to being fixed to the opening part of the container, it is not possible to stretch the foil by mechanical means, e.g. between its edges, so as to prevent the undesirable deformation (curling up) which on sealing of e.g. hot-filled containers entails only too often the occurrence of leaky closures.

SUMMARY OF THE INVENTION

In accordance with the present invention the aforementioned problem of sealing a container by means of a foil cut in advance, which forms a wafer of a shape adapted to the shape of the opening part of the container which is to be sealed, is eliminated.

This is achieved by means of a method and a device which are specified in the characterizing parts of claim 1 and claim 10, respectively.

In a preferred embodiment of the invention the sealing of the container takes place while an outer sealing means, in leakproof manner, delimits a space which accomodates the edge zone and the storage space of the container, the space being evacuated and, whilst maintaining a vacuum, the edge zone of the wafer being fixed in leakproof manner to the joining means.

The invention also comprises embodiments where for the formation of the joint between the wafer and the actual joining means, a fixing agent (bonding layer) is applied to the underside of the wafer, exclusively to the bonding surface of the opening part or to the underside of the wafer as well as to the bonding surface of the opening part. It is obvious that in certain applications such an agent is applied exclusively to the bonding surface of the opening part. It is obvious that in certain applications the agent is coated exclusively onto the underside of the outer edge zone of the wafer.

BRIEF DESCRIPTION OF THE FIGURES OF THE DRAWING

The invention is described in more detail in connection with a number of figures, wherein.

DETAILED DESCRIPTION

Figure 1:
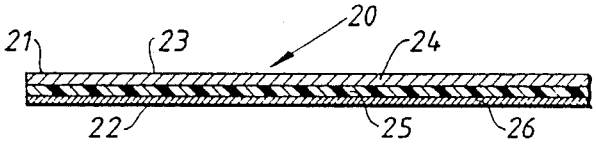
FIG. 1 shows a section through a wafer.

In FIG. 1 is to be found a wafer 20 of a shape adapted to the shape of the joining means, e.g. a flange, of the opening part of the container which is to be sealed by means of the wafer. In the embodiment shown in FIG. 1 the wafer comprises two layers 24, 25. The upper side of the wafer has the reference number 23 and its underside the reference number 22. The wafer 20 is defined by an outer edge zone 21 closed in the peripheral direction of the wafer, as a rule adjoining the edge or edges of the wafer. In the embodiment shown in FIG. 1 the upper layer consists of a metallic material, e.g. aluminium, and the lower layer of a plastic material. The lower layer in turn is coated with an adhesive layer 26, e.g. a glue layer. It will be obvious, though, to those versed in the art, that in addition to the embodiment shown in FIG. 1, the invention is applicable to wafers made up of layers which deviate as to number and type from what has been specified above. In certain embodiments are included, e.g. layers exclusively of metal foils or exclusively of plastic material whilst, as a rule, at least one layer of barrier material is also included.

Figure 2:
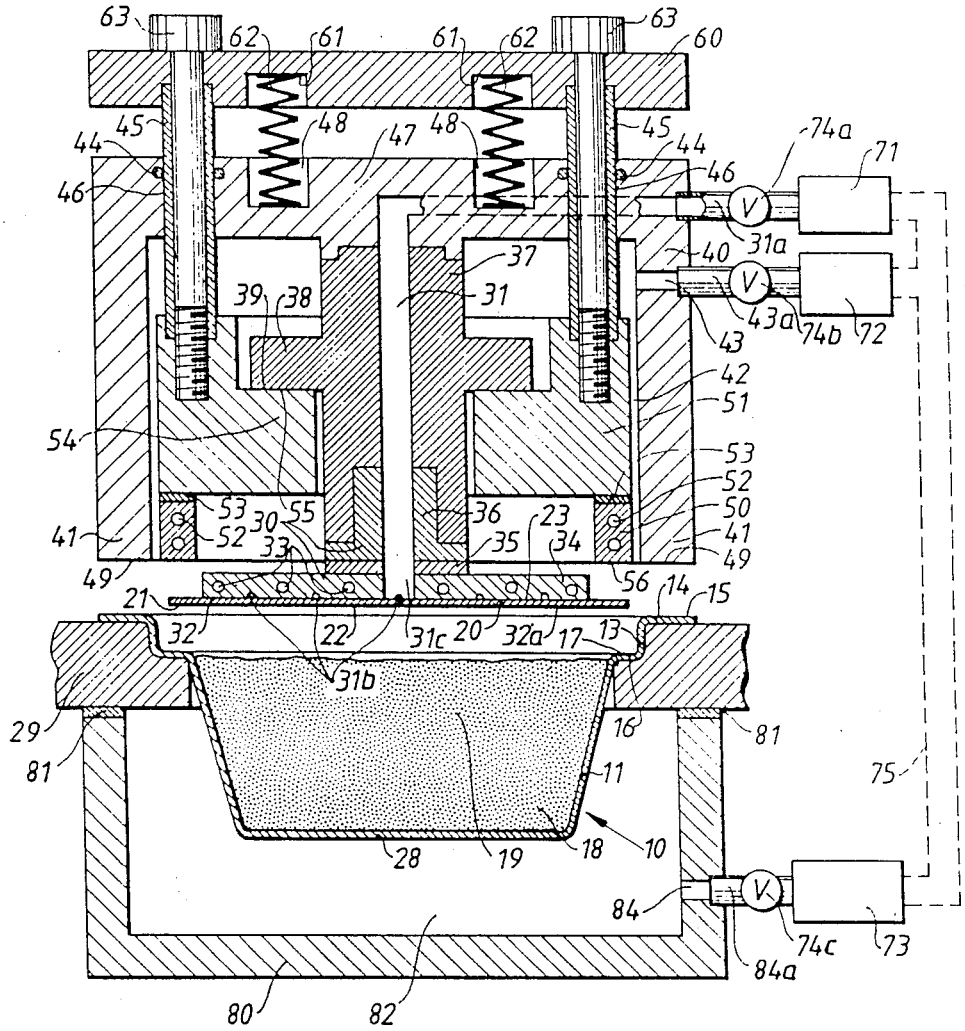
FIGS. 2–4 are axial sectional views of a device for the sealing of a container showing successive sealing stages.
Figure 3:
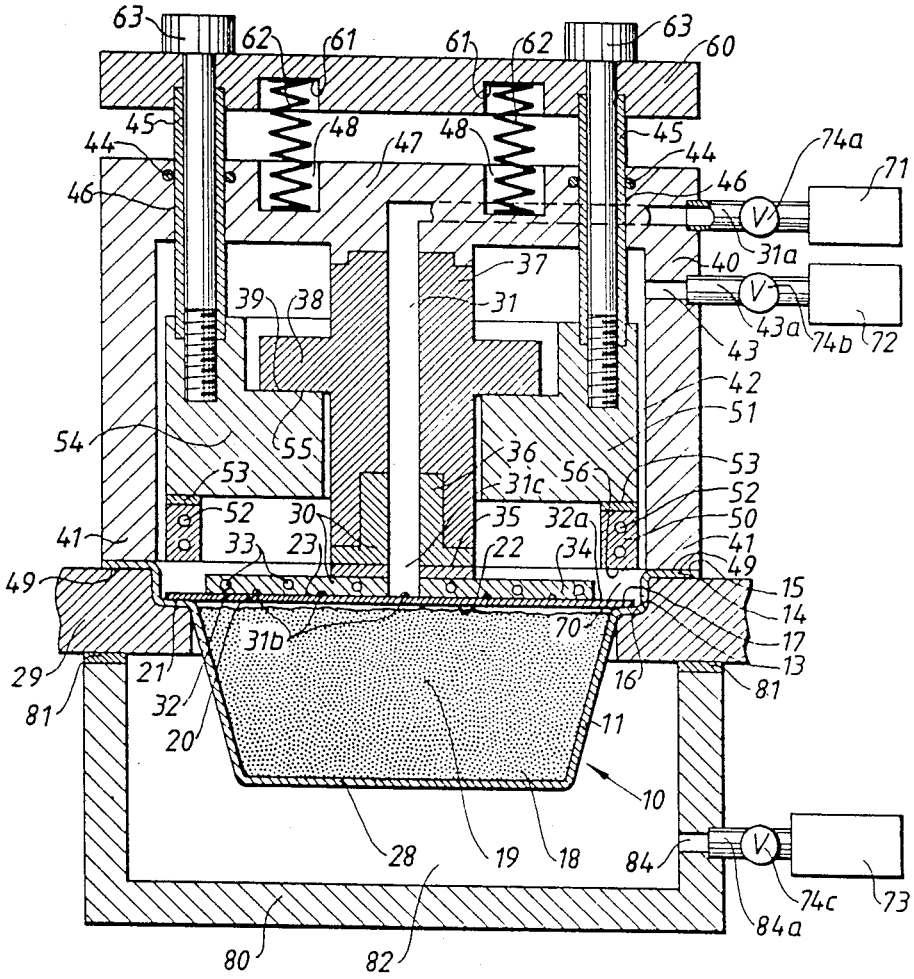
Figure 4:
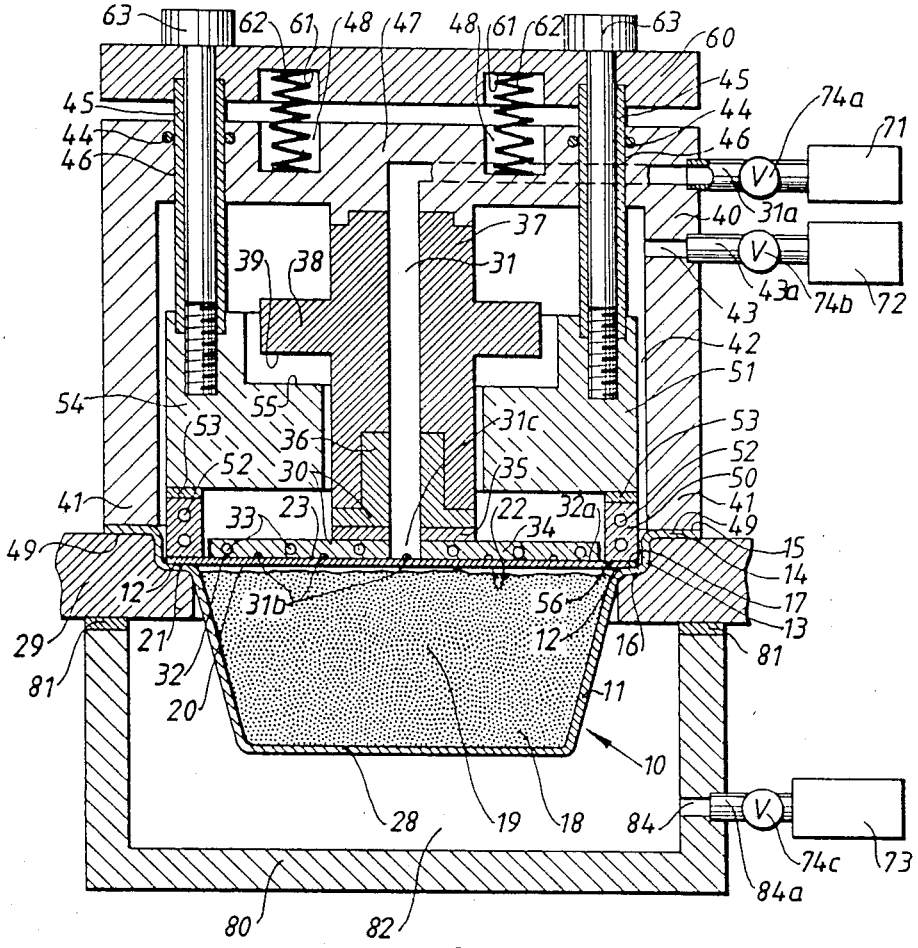

In FIGS. 2–4 is to be found a container 10 with a sealed bottom part 28, a container wall 11 and an opening part 13. The opening part is provided with joining means 14, 16 to cooperate with outer sealing means 40—described further below—and/or with fixing means 50 by which the wafer is fixed to the opening part of the container. The joining means in the embodiment of the container shown are in the form of an upper flange 14 and a shoulder 16 arranged underneath it. Reference numbers 15 and 17 respectively relate to an upper boundary surface on the flange and on the shoulder respectively. The container has a storage space 18 which in the figures is shown as filled with goods 19. The opening part 13 of the container rests on a supporting means 29 which supports the container while it is being sealed. In the embodiment of the device in accordance with the invention shown, the wafer 20 is held (see e.g. FIG. 2) by a retaining means 30 shown in an embodiment with a lower part 34 and an upper part 36 and with an insulation 35 present between these two parts. In the lower part are provided ducts 33 for adjustment of the temperature. The lower part has a lower surface 32 which constitutes the contact surface for the wafer. The retaining means is provided with a duct 31 which is connected to a first source of vacuum 71 via a, generally, flexible pipeline 31*a*. The duct is finished off by one or more openings 31*c* (see FIG. 5) which are located in the contact surface 32 of the retaining means and which as a rule are placed centrally. The upper part 36 of the retaining means is connected to a first guiding and transfer means 37 which is provided with one or more projections 38 directed away from the center having a striking surface 39 facing downwards in the figure.

An outer sealing means 40 has a contact part 41 intended to be moved to and from a position wherein, according to the embodiment shown, the contact part rests with a sealing surface 49 against the opening part 13 and, in particular, against the upper boundary surface 15 of the flange 14 of the opening part. The pressing surface 49 of the outer sealing means 40 is adapted to the shape and structure of the opening part 13 in the region where the pressing surface cooperates with the opening part, e.g. adapted to the upper boundary surface 15 of the flange so that, on resting against the same in a substantially leakproof manner, it permits means 40 to form a delimited closed space 70, hereinafter referred to also as first space 70 (see FIG. 3), which accomodates the retaining means 30, the wafer 20 and also the storage space 18 of the container.

The sealing means 40 has an upper part 47, hereinafter as a rule referred to as a coupling plate 47, for the connection of the sealing means to a top plate 60. In the top plate as well as in the coupling plate spring mountings 61 and 48 respectively are provided which cooperate with springs 62 adapted to transfer the movement of the top plate to the coupling plate. The top plate is connected by a coupling means 51 via one or more coupling bolts 63 to a fixing means 50, finished off by a pressing surface 56, which in the figure is directed downwards, that is to say towards the edge zone 21 of the wafer. The coupling bolts and the coupling means thus constitute the means of connection and transfer for the cooperation of the top plate with the fixing means 50. The fixing means is provided with heating means 52 which may be constituted e.g. of electric heating wires or ducts for a heating medium. An insulation 53 prevents heat transfer between the fixing means and the coupling means 51. The coupling means 51 is provided with one or more projections 54, directed towards the center of the device with a striking surface 55, directed upwards in the figure, intended to cooperate with the striking surface 39 of the projections 38 of the first guiding and transfer means 37.

Between the fixing means 50 with its coupling means 51 and the outer sealing means 40 a passage is formed, shown in the figures in an embodiment where it contitutes a gap 42, this passage connecting via a duct 43 and a, generally flexble, pipeline 43*a* connected thereto, the space 70 enclosed by the sealing means 40 to a second source of vacuum 72. It is obvious that in certain embodiment a corresponding passage to the second source of vacuum 72 is obtained in that the duct 43 opens out in a region close to the fixing means 50, that is to say in a region close to the opening part of the container, whereas in other embodiments the fixing means and/or its coupling means 51 are provided with passages which connect the space 70 to the duct 43 and/or the source of vacuum. In certain cases the two ducts 31, 42 are connected to a common source of vacuum.

The coupling plate 47 of the outer delimiting means 40 is provided with bearings 46 for bearing sleeves 45 which enclose the connecting bolts 63. The bearing sleeves are displaceable in the bearings 46. Seals 44, preferably designed as O-rings, are provided in the bearings 46 so as to prevent a passage of gas into the space 70 which is delimited by the sealing means 40 when it rests against the opening part 13 of the container.

As a rule the device in accordance with the invention also includes a lower delimiting means 80 which is joined in a leakproof manner to the supporting means 29 so as to form a second closed space 82 which is delimited by the lower delimiting means and by the supporting means 29. When the container 10 is supported by the supporting means 29, at least the lower part of the container as a rule projects into the second space 82 as a result of which the container, the supporting means and the lower delimiting means form the closed space. Sealing means 81 fitted to the lower delimiting means and/or to the supporting means ensure that the delimiting means is joined in a leakproof manner to the supporting means 29 in a region enclosing the container 10. The lower delimiting means is provided with a passage 84 which via a connection 84*a*, e.g. a, generally flexible, pipe or a duct, connects to a third source of vacuum 73. In certain embodiments the lower delimiting means is adapted so as to be movable in relation to the supporting means 29 in order to make it possible to displace the supporting means and the delimiting means from one another in conjunction with the conveying of the container to and from the sealing station. In this manner an improved accessibility is also obtained to the region underneath the container 10 when it rests against the supporting means 29.

Valve element 74*a-c* are provided in the conduits 31*a*, 43*a*, 84*a* to the sources of vacuum 71, 72, 73. By means of control means, not shown in the figures, an individually controlled opening or closing of the connections between the sources of vacuum and the ducts 31, 43 and 84 respectively by means of the valve elements is made possible.

In certain embodiments of the invention one single source of vacuum common to all ducts is used or, as an alternative, the sources of vacuum are joined to one another by means of a conducit 75 indicated by broken lines in FIG. 2.

Figure 5:
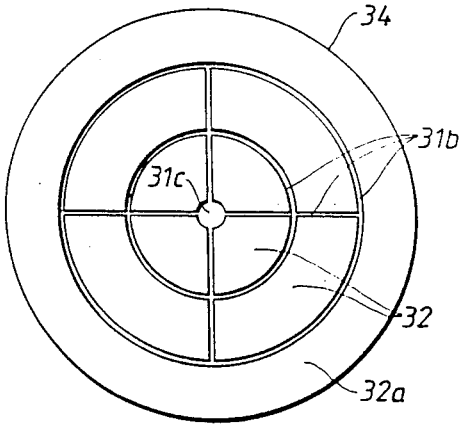
FIG. 5 shows the retaining means of the device seen from below.

In FIG. 5 is shown in detail an example of an embodiment of the contact surface 32 of the retaining means. In the example the surface is provided with grooves 31*b* which are connected to the opening 31*c* of the vacuum duct 31. These grooves are distributed over the contact surface 32 insise a closed boundary zone 32*a* located in the circumferential direction of the contact surface. When the wafer rests against the contact surface, the grooves, owing to the connection of the grooves to the source of vacuum, form vacuum ducts which hold the wafer tightly on the retaining means 30.

FIG. 2 shows the wafer 20 resting against the retaining means 30 owing to the partial vacuum prevailing in the grooves 31*b* of the contact surface. Through the relative movement between the supporting means 29 and the retaining means 30 along with other means cooperating with the retaining means, the wafer 20 has been placed in a position directly above the opening part 13 of the container 10. The wafer is kept at the desired temperature, as a rule a low temperature, by a medium, which generally for the cooling of the lower part 34 of the retaining means, passes through the ducts 33.

By driving means, not shown in the figures, the top plate 60 is moved downwards in the direction towards the container 10 (see FIG. 3), the retaining means 30 moving the wafer 2 until it rests against the shoulder 16 of the opening part. The outer sealing means 40 and the fixing means 50 with its coupling means 51 also follow the downward movement. The sealing means in fact is moved down to rest against the opening part 13 and, in the embodiment shown, to rest against the upper boundary surface 15 of the flange 14. The first space 70 which is now delimited by the sealing means 40 is connected thereafter to the second source of vacuum 72 by means of the duct 43. As a result a vacuum is created in the whole of the enclosed region which also includes the storage space 18 of the container. The vacuum entails that air and/or other gases, which are present underneath the wafer 20, are sucked out from the space underneath it and pass between the edge zone 21 of the wafer and the opening part 13, as a rule the upper boundary surface 17 of the shoulder. The pressure in the first space 70 is adjusted as a rule to a value which is higher than the pressure which prevails in the grooves **31*b* of the retaining means 30**, thus ensuring that the wafer is not detached from the retaining means.

In the embodiments comprising the lower delimiting means 80 a reduction of the pressure generally takes place also in the second (lower) space 82 at the same time as the pressure in the first space 70 above the contents is reduced. It is obvious that this simultaneous reduction of pressure is achieved through opening of the valves **74*b*, 74*c* in the pipeline or piplines connected to the source of vacuum. The reduction of pressure in the lower space 82** is performed, when there is a danger that the pressure difference across the container wall might cause a deformation of the container.

The top plate 60 thereafter is moved by its driving means further downwards towards the container 10 (see FIG. 4). Since the sealing means 40 already rests against the flange 14, the bolts 63 and the bearing sleeves 45 are displaced in the bearings 46, with simultaneous compression of the spring 62. In the course of this the fixing means 50 is moved to rest against the edge zone 21 of the wafer and the latter is pressed by the pressing surface 56 of the fixing means against the shoulder 16. The width of the edge zone 21 of the wafer, that is to say the width of the area of the wafer outside the contact surface 32 of the retaining means, is adapted to the rise in temperature occurring in the wafer material and the characteristics of the wafer material, so as to prevent the movement (curling) upwards or downwards of the edge region from becoming so great that the correct contact of the edge region with the shoulder 16 might be jeopardized. The fixing means is adjusted by the heating means 52, e.g. ducts or electric heating wires, to a predetermined temperature adapted to the type of joint by means of which the wafer is to be attached to the container 10. The top plate, and thereby the fixing means, are maintained in their lower position for a sufficiently long period to allow the joint or joints 12 to be formed and the wafer be fixed to the container e.g. through the supply of the required amount of energy to the connecting region. After the joints have been formed, the connection to the respective source of vacuum is cut off and the driving means for the top plate moves the latter in the direction away from the container (upwards in the figure). In an alternative embodiment of the invention the movement takes place in that the connection of the driving means to the top plate is interrupted and the springs 62 move the top plate to the position shown in FIG. 3. By the driving means the top plate thereafter is moved to the position shown in FIG. 2, whereby the striking surfaces 39 and 55 of the projections 38 and 54, respectively, rest against each other, as a result of which the projections 54 move the first guiding and transfer means 37, and consequently the retaining means 30, in the direction away from the container 10. Through the relative movement between the supporting means 29 and the retaining means 30 along with means associated with the retaining means, the retaining means subsequently is given the opportunity of picking up a new wafer, whereupon the procedure described above is repeated.

The retaining means 30 has been shown in FIG. 5 in an embodiment where it has a mainly circular cross-section. It will be obvious to those versed in the art that the invention is applicable to any arbitrary cross-section, and thus also to polygonal ones.

The invention has been described in connection with embodiments which in the drawings illustrate how the wafer is fixed to the shoulder 16 of the container. It is self-evident that the invention likewise can be applied to embodiments where the wafer is fixed to the upper boundary surface of the flame 14. In this case it is ensured that the contact part 41 of the sealing means 40 alternatively rests only against an upper outer part situated in the circumferential direction of the container flange 14 or e.g. against the underside of the flange or against the supporting means 29, and that the wafer 20 rests against the flange 14, inside the sealing means 40. The fixing means 50 with its pressing surface 56 then presses the edge region 21 against the flange 14. The flexibility in the wafer material makes it possible, in this embodiment of the invention too, for the air and/or other gas to be sucked out from the region existing underneath the wafer 20.

As a rule it is desirable in case of the type of goods involved herein, that the free space between the goods (the liquid) and the wafer should be as small as possible. In applications where the goods are warm, that is to say at temperature of approx. 60° C., and especially if the temperature exceeds 75°–80° C., the heat effect of the goods upon the wafer is very strong. In such applications there is a risk of an undesirable curling taking place in the edge zone. As is evident from the above, however, it is possible to adapt the lower part of the retaining means to the size of the wafer so that the part of the wafer which is radially outside the retaining means is subjected to very little expansion in the radial direction. As a result the risk of such undesirable curling in the edge region is minimized.

In certain applications the wafer is ultrasonically welded to the opening part of the container by means of a sonotrode which constitutes the fixing means 50 and which supplies the required energy to the fixing region in order to form joints 12. In the above description terms have been used frequently which relate to a circular cross-section of the container. It is obious, though, that the invention as such is applicable to any arbitrary cross-section of the container as well as of its opening part. Herein are included all forms of cross-sections having curved contours and polygonal cross-sections and combinations thereof. It is obvious that in accordance with the invention the fixing means 50 is adapted so that on sealing of the container it attaches the wafer by providing more than one joint 12.

The above detailed description referred only to a limited number of embodiments of the invention, but it will be readily evident to those versed in the art that the invention embraces a large number of embodiments within the scope of the following claims.

What is claimed is:

1. A method for vacuum sealing an open container comprising engaging a sealing wafer in a central region thereof to leave an annular peripheral region of the wafer free, providing relative movement between said sealing wafer and said open container to contact the free annular peripheral region of the sealing wafer with an annular portion of said container surrounding an opening in the container so that the sealing wafer covers said opening, forming a space adjacent to the container and extending around said annular portion, and said space being formed by displacing an outer sealing means into contact with the container in a region thereof outside the region where the wafer contacts the container, reducing the pressure in said space and in said container, via said free annular peripheral region of the wafer, before the sealing joint is formed, and forming a fluid-tight sealing joint between the annular peripheral region of the sealing wafer and in annular portion of the container to seal said opening of the container by said wafer.

2. A method as claimed in claim 1 wherein said sealing joint is formed by applying pressure to the annular peripheral region of the sealing wafer and the annular portion of the container.

3. A method as claimed in claim 1 comprising supplying energy to the annular peripheral region of the sealing wafer and the annular portion of the container.

4. A method as claimed in claim 1 wherein said central region of the wafer is engaged by applying suction to said central region.

5. A method as claimed in claim 1 comprising cooling the central region of the wafer while the sealing joint is being formed.

6. A method as claimed in claim 1 wherein said annular portion of the container is formed by a shoulder of the container.

7. A method as claimed in claim 1 wherein said wafer is formed by superimposing a plurality of layers on one another, at least one of said layers being a metal.

8. A method as claimed in claim 7 wherein said metal is aluminum.

9. A method as claimed in claim 1 wherein said central region of the wafer is engaged by applying suction thereto, the pressure in said space being higher than the suction pressure applied to the wafer.

10. A method as claimed in claim 1 comprising reducing the pressure around the body of said container to substantially equalize the pressure around the body of the container with the suction pressure developed therein and prevent deformation of the container.

11. Apparatus for vacuum sealing an open container by a sealing wafer, said apparatus comprising:

support means for supporting a container having an opening, retaining means for holding a sealing wafer, which is to close and seal said opening, in spaced relation with said opening, means for providing relative movement between the retaining means and the support means to bring said sealing wafer into contact with the container around said opening so that the sealing wafer covers said opening, fixing means for sealing said wafer and said container where they are in contact to form a liquid-tight sealing joint, said retaining means having a contact surface for the sealing wafer, means for producing suction at said contact surface to hold said sealing wafer against said retainer means, means for cooling said contact surface at least in a region proximate said sealing joint, said sealing wafer having an annular peripheral region extending beyond said retaining means which is brought into contact with the container upon relative movement of the retaining means and support means, said fixing means being positioned to form said sealing joint between said annular peripheral region of the sealing wafer and the region of the container with which it is brought into contact, a displaceable outer sealing means surrounding said wafer.

means for displacing said outer sealing means to bring said outer sealing means into contact with the container before the fixing means seals the wafer and the container and to define a space adjacent to the container and to said annular peripheral region of the sealing wafer, and means for applying suction to said space to evacuate the interior of the container prior to formation of said sealing joint.

12. Apparatus as claimed in claim 11 wherein said fixing means is surrounded by said outer sealing means and is movable relative thereto.

13. Apparatus as claimed in claim 11 comprising drivable coupling means, transfer means connecting said outer sealing means to said coupling means for moving said outer sealing means into contact with the container, said transfer means including resilient means for transmitting force from the coupling means to the outer sealing means.

14. Apparatus as claimed in claim 13 comprising means guidably supporting the coupling means from the outer sealing means.

15. Apparatus as claimed in claim 13 wherein said fixing means is secured to said coupling means for movement therewith so that said outer sealing means can contact said container while the fixing means is spaced from said wafer and thereafter said fixing means can be brought into contact with said wafer by deformation of said resilient means.

16. Apparatus as claimed in claim 11 wherein said support means supports said container in a suspended condition and defines a second space below the suspended container, said apparatus further comprising means for producing suction in said second space.

17. Apparatus as claimed in claim 12 wherein said fixing means and said outer sealing means define a gap therebetween which connects said space and said suction means.

18. Apparatus as claimed in claim 15 comprising means connecting said sealing means and said retaining means for conjoint movement from said coupling means.

19. Apparatus as claimed in claim 11 wherein said retaining means applies a suction pressure to said wafer which is higher than the suction pressure in said space.

* * * * *